US010640993B2

(12) United States Patent
Apostolopoulos

(10) Patent No.: US 10,640,993 B2
(45) Date of Patent: May 5, 2020

(54) METHOD FOR ADJUSTABLY SUSPENDING A STRUCTURE

(71) Applicant: Paul Apostolopoulos, Amherst, NY (US)

(72) Inventor: Paul Apostolopoulos, Amherst, NY (US)

(73) Assignee: Paul Kristen, Inc., Tonawanda, NY (US)

( * ) Notice: Subject to any disclaimer, the term of this patent is extended or adjusted under 35 U.S.C. 154(b) by 30 days.

(21) Appl. No.: 15/727,709

(22) Filed: Oct. 9, 2017

(65) Prior Publication Data

US 2018/0030744 A1 Feb. 1, 2018

Related U.S. Application Data

(62) Division of application No. 13/463,595, filed on May 3, 2012, now Pat. No. 9,784,001.

(60) Provisional application No. 61/481,838, filed on May 3, 2011.

(51) Int. Cl.

| | |
|---|---|
| ***E04G 3/30*** | (2006.01) |
| ***E04G 7/04*** | (2006.01) |
| ***E04G 7/20*** | (2006.01) |
| *E01D 19/10* | (2006.01) |

(52) U.S. Cl.

CPC ..... *E04G 3/30* (2013.01); *E04G 7/04* (2013.01); *E04G 7/20* (2013.01); *E01D 19/106* (2013.01)

(58) Field of Classification Search

CPC ..... A62B 35/0056; A47B 43/003; E04G 3/30; E04G 3/32; E04G 5/00; E04G 7/04; E04G 7/20; F16B 45/00

See application file for complete search history.

(56) References Cited

U.S. PATENT DOCUMENTS

| | | | | | |
|---|---|---|---|---|---|
| 1,198,122 | A * | 9/1916 | Golden | E04G 3/30 | 182/142 |
| 1,409,755 | A * | 3/1922 | Morrow | E04G 25/06 | 254/100 |
| 1,725,183 | A * | 8/1929 | Fischer | E04G 3/32 | 182/130 |
| 2,966,228 | A * | 12/1960 | Kowalski | E04G 3/22 | 182/113 |
| 3,139,045 | A * | 6/1964 | Rojakovick | A47B 43/003 | 108/109 |
| 3,524,520 | A * | 8/1970 | Tidwell | E04G 3/30 | 182/150 |

(Continued)

*Primary Examiner* — Katherine W Mitchell
*Assistant Examiner* — Shiref M Mekhaeil
(74) *Attorney, Agent, or Firm* — James C. Simmons

(57) ABSTRACT

A method utilizing an assembly of a sling detachably attached to an adjustment device for suspending one structure relative to another structure. The adjustment device comprises a pair of elongate spaced apart plates which are attached to each other and to a hook, for attachment to one of the structures, at the first end portion. Each plate has a plurality of pairs of longitudinally spaced aligned holes for receiving a pin for connecting one end of a sling to the adjustment device at a selected incremental one of the plurality of pairs of holes. The other end of the sling is connected to the other structure to adjust the distance over which the one structure is suspended relative to the other structure. To allow greater adjustability, two or more of the adjustment devices are joined end-to-end.

14 Claims, 4 Drawing Sheets

(56) References Cited

U.S. PATENT DOCUMENTS 4,000,557 A * 1/1977 Bawden ..... B21F 15/06 29/525
4,103,871 A * 8/1978 Patterson, III ..... B60P 7/083 254/266
4,334,812 A * 6/1982 Delatush ..... B60P 7/14 206/478
4,441,583 A * 4/1984 Vaught ..... E04G 3/22 182/150
4,815,563 A * 3/1989 Puccinelli ..... E04G 3/30 182/113
5,145,032 A * 9/1992 Puccinelli ..... E04G 3/30 182/119
5,160,109 A * 11/1992 de Leeuw ..... E04G 11/483 248/354.4
5,522,579 A * 6/1996 Rock ..... E04G 13/04 249/211
5,730,248 A * 3/1998 Apostolopoulos .... E01D 19/106 182/138
6,035,692 A * 3/2000 Lucas ..... B21F 15/06 29/517
6,170,145 B1 * 1/2001 Lucas ..... B21F 15/06 29/282
6,227,331 B1 * 5/2001 Apostolopoulos .... E01D 19/106 182/138
6,264,002 B1 * 7/2001 Apostolopoulos .... E01D 19/106 182/138
6,367,585 B1 * 4/2002 Fast ..... A01M 31/02 182/135
8,113,479 B1 * 2/2012 O'Connell ..... A62B 3/00 248/351
8,839,591 B2 * 9/2014 Guthrie ..... E04G 21/3276 248/231.9
2002/0193215 A1 * 12/2002 Cheng ..... A63B 21/063 482/99
2004/0020138 A1 * 2/2004 Grearson ..... E01D 19/106 52/64
2006/0076755 A1 * 4/2006 Bergeron ..... B60D 1/24 280/509
2006/0108176 A1 * 5/2006 Funes Gavilan ... E04G 21/3233 182/20
2007/0264076 A1 * 11/2007 McCracken ..... E04G 25/061 403/315
2008/0073398 A1 * 3/2008 Plaschka ..... B60R 9/06 224/519
2008/0087497 A1 * 4/2008 Boswell ..... A62B 1/02 182/142
2011/0052314 A1 * 3/2011 Lindsey ..... B66C 1/12 403/210
2011/0085854 A1 * 4/2011 Apostolopoulos .... E01D 19/106 403/399

* cited by examiner

METHOD FOR ADJUSTABLY SUSPENDING A STRUCTURE

This is a divisional of U.S. patent application Ser. No. 13/463,595, filed May 3, 2012 (having an issue date of Oct. 10, 2017, as U.S. Pat. No. 9,784,001), which is hereby incorporated herein by reference. Priority of U.S. provisional application 61/481,838, filed May 3, 2011, which is hereby incorporated herein by reference, is hereby claimed.

The present invention relates generally to a method for suspending a structure relative to another structure. The method may be used, for example, in the temporary erection of platforms below a bridge deck so that cleaning, painting, or other maintenance work may be performed thereon. More particularly, the present invention relates to the use of suspension devices such as slings. For example, slings may be used for attaching such platforms or other scaffolding members to overhead structures such as bridge decks so that they are suspended at a desired height therefrom. The present invention is also applicable for the suspension of other things.

Applicant's company, Safespan Platform Systems, Inc., has for many years provided and erected temporary platforms or scaffolding below bridge decks, as exemplified in their U.S. Pat. Nos. 5,730,248; 5,921,346; 6,003,634; 6,135,240; 6,138,793; 6,227,331; 6,264,002; 6,302,237; 6,386,319; and 6,523,644, and published application 2011/0085854, all of which patents and published application are incorporated herein by reference.

Such a sling is illustrated at 32 in FIGS. 1, 2, and 30 of the aforesaid U.S. Pat. No. 6,523,644 (wherein it is called an auxiliary support cable), wherein the lower ends of slings are attached to a platform (which is also supported by underlying cables) and their upper ends are attached to bridge structure.

A sling in accordance with the prior art is illustrated at 10 in the drawings. A sling 10 is a length of cable 15 (or wire rope or other suitable flexible strand) having attachment means in the form of a loop or eye or eyelet 12 at each end wherein the cable is folded back over and attached to itself to form an eyelet or loop, and a protective thimble 17 suitably received within the eyelet. The sling 10 shown in FIGS. 1 and 2 is of a type which is non-adjustable, comprising at each end an eyelet 12 wherein the cable is attached to itself permanently by a swaged connection utilizing a swage sleeve 14 (which may come in various sizes such as, for example, a diameter of ½ inch) which is caused to encircle and firmly grip the cable thereby providing a strong connection of the cable to itself thereby forming the eyelet. The thimbled eyelets 12 are connected to structures by suitable clips, illustrated schematically at 18, for use of the sling 10 for supporting, for example, a platform from a bridge deck, illustrated at 16. The lower thimble 12 could, for example, be attached to a similar clip for attachment to, for example, a platform to be suspended below the bridge deck. Examples of such slings are found in U.S. Pat. Nos. 4,000,557; 6,035,692; and 6,170,145, and in U.S. published application 2011/0052314 all of which patents and published application are incorporated herein by reference. Such a sling has been used for many years in scaffolding with great effectiveness when the height is fixed and requires no adjustability.

There are often instances requiring the adjustment of the lengths of the slings in-situ or in the field during the erection process, and length adjustable slings, wherein the eyelet at one end is formed in the field during the erection process, have been provided for this purpose. A length-adjustable sling in accordance with the prior art is illustrated generally at 20 in FIG. 3, and includes the permanent swaged connection 14 at one end, similarly as illustrated in FIGS. 1 and 2. The other end of the cable 15 is looped around to also form an eyelet 26. Instead of a swage, cable portions are held together to form the eyelet 26 by a plurality of suitable clamps, illustrated schematically at 22, which can be loosened to adjust the sling length then tightened at that desired adjusted sling length.

The clamps 22 are typically applied in the field during the erection process, then the cable end, illustrated at 24, pulled through until the desired height or sling length is obtained, then the clamps tightened. While such adjustable slings 20 as in FIG. 3 are effective for their purpose, it undesirably takes a long time to put on the clamps 22 and conduct the adjustment. Moreover, the tightening of the clamps 22 undesirably puts kinks in the cables with the result that it is considered unsatisfactory to re-use the slings. Thus, there has been a long-existing need in the scaffolding industry for suspension assemblies which include slings wherein such a suspension assembly can be more easily length-adjusted and which are satisfactory for re-use.

It is accordingly an object of the present invention to provide a suspension assembly wherein the length or height over which it is used can be easily adjusted.

It is another object of the present invention to provide a suspension assembly wherein the length or height over which it is used can be adjusted in a manner so as not to result in kinks in the cables so that the suspension assemblies/slings can be satisfactorily re-used.

In order to provide for easy adjustability of the length or height over which a suspension assembly is used and without kinking the cable thereby allowing re-use of the suspension assembly/sling, in accordance with the present invention, an adjustment assembly (or assemblies) is provided to which an eyelet of a sling is attachable at incremental positions, an end portion of the adjustment assembly being attachable to a structure.

The above and other objects, features, and advantages of the present invention will be apparent in the following detailed description of the preferred embodiment(s) thereof when read in conjunction with the accompanying drawings wherein the same reference numerals denote the same or similar parts.

DETAILED DESCRIPTION OF THE PREFERRED EMBODIMENT(S)

Figure 1:
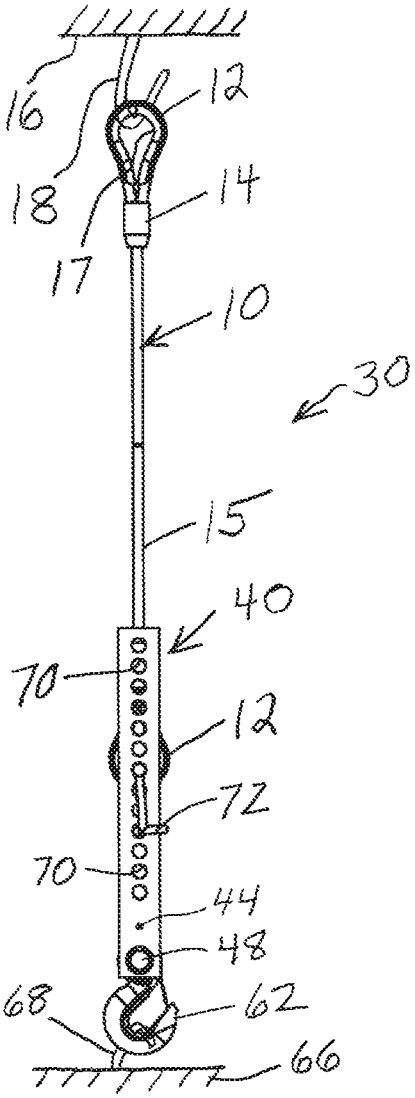
FIG. 1 is a front elevation view of a suspension assembly in accordance with the present invention, including a sling and an adjustment device for providing adjustability to the sling.
Figure 2:
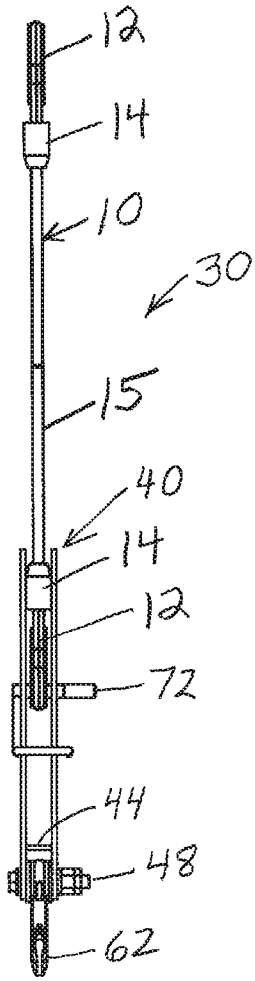
FIG. 2 is a side elevation view thereof.
Figure 4:
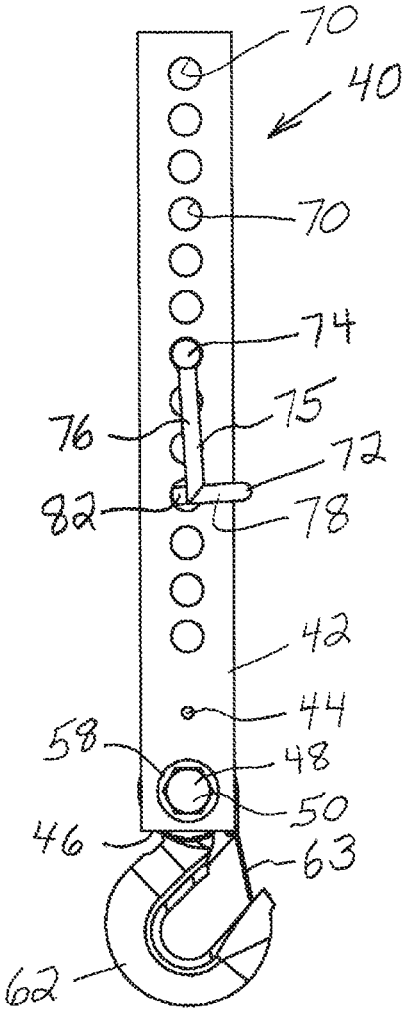
FIG. 4 is a view similar to that of FIG. 1 of the adjustment device.
Figure 5:
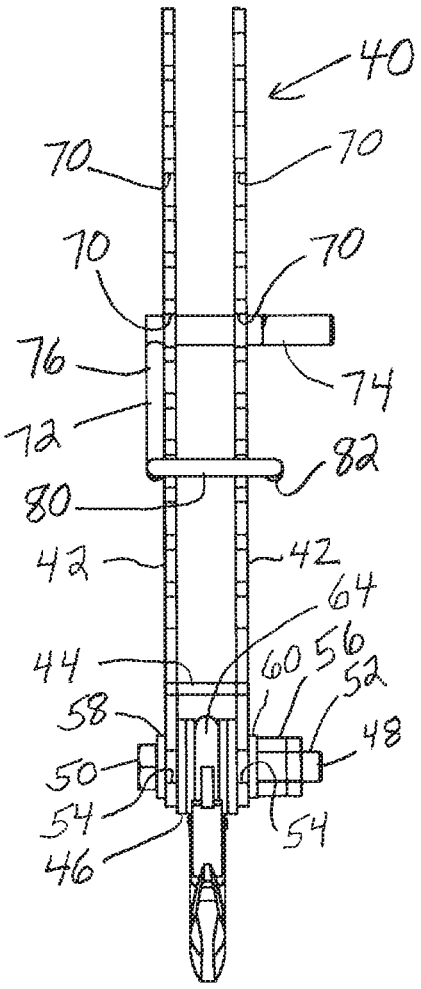
FIG. 5 is a view similar to that of FIG. 2 of the adjustment device.
Figure 6:
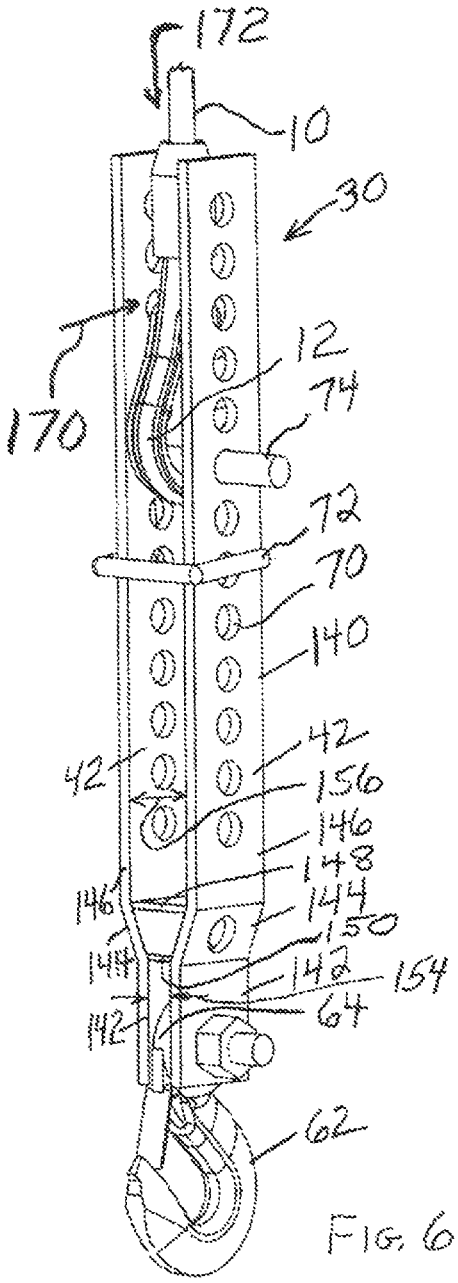
FIG. 6 is a perspective view of an alternative embodiment of the adjustment device, with a sling (shown partially) attached.

Referring to FIGS. 1 and 2, there is shown generally at 30 a suspension assembly, which comprises a combination of an otherwise non-adjustable conventional sling 10 and an adjustment device, illustrated generally at 40, for adjustably attaching to the sling 10 for providing adjustability to the sling 10 thereby providing an adjustable suspension assembly 30. FIGS. 4 and 5 show the adjustment device 40 itself, and FIG. 6 shows a modified form thereof. Each of the parts thereof, unless otherwise specified or unless apparently otherwise, is composed of steel or other suitable material.

Referring to FIGS. 4 and 5, the adjustment device 40 comprises a pair of spaced elongate planar plates 42 connected adjacent a lower end 46 by a suitable pin or bolt 48 having a head 50 and whose shank 52 is received in holes, illustrated at 54, in the plates 42 respectively and fastened with a nut 56 with washers 58 and 60 for the head and nut respectively. Each of the plates 42 may, for example, have a thickness of about ¼ inch, a width of about 2 inches, and a length of about 17 inches.

An eye hook 62, with a safety latch 63, has a portion 64 which is received between the plates 42 (the hook extending downwardly from the ends of the plates 42), the portion 64 having an aperture (not shown) in which the bolt shank 52 is received. A pair (or more) of spacers 66 are also received on the shank 52 on opposite sides of the hook portion 64 to allow for or fill in the desired spacing between the plates 42 to avoid play but allowing free movement of the hook 62.

Adjacent the position of the fastener 48, a pin 44 is provided to suitably connect the plates 42 in a manner to maintain alignment and a desired spacing between the plates 42 so that the hook 62 may be loosely received so that it may swivel about the bolt shank 52, which may have diameter of, for example, about ⅝ inch, with the bolt assembly being, for example, a grade 8 bolt assembly. It should be understood that the hook 62 can be otherwise suitably attached and the plate spacing otherwise suitably maintained, an alternative embodiment thereof being described hereinafter with respect to FIG. 6, as can be understood by those of ordinary skill in the art to which the present invention relates. As seen in FIG. 1, the hook 62 (instead of the lower eyelet 12) is connected to a structure, for example, a temporary platform 66 by a suitable clip, illustrated schematically at 68. Thus, the adjustable suspension assembly 30 allows the suspension assembly height (length) to be adjusted to match the desired height of the platform 66 relative to another structure 16, such as a bridge deck, as hereinafter discussed. The spacing between the plates 42 allow adjustability for different sizes (widths) of cable eyes 12, i.e., the greater the spacing, the wider the cable eye 12 may be that may be inserted between the plates 42.

In order to provide sling height (length) adjustability, in accordance with the present invention, spaced over the length (height) of each plate 42 are a plurality of spaced holes, illustrated at 70, the holes of one plate being in alignment with the holes respectively of the other plate. To connect the sling 10 to the adjustment device 40, the lower sling eyelet 12 is received between the plates 42, and the pin portion 74 of a scaffold pin 72 is received in a hole 70 in one plate 42, then within the sling eyelet 12, then in the respectively aligned hole 70 in the other plate 42. The number and spacing for the pairs of aligned holes is dependent on the particular application, i.e., the height over which the sling is to be adjusted and how precise of adjustment is required. For example, there may be 13 aligned pairs of holes 70, each having a diameter of, for example, about 11/16 inch and each pair of holes spaced, for example, about 1 inch (center-to-center) thereby allowing height adjustability in 1 inch increments over a height of about a foot, the sling height being determined by attaching the eyelet at a selected pair of aligned holes.

The scaffold pin 72, which may also be referred to as an adjustment retainer, also includes a locking part 75 which utilizes gravity for retaining the pin portion 74 in the holes 70 as follows. The locking part 75 includes a first portion 76 which extends normal to the pin portion 74 from an end thereof to extend lengthwise along one of the plates 42, a second portion 78 which extends normal to the first portion 76 from the end thereof to extend to an edge of the one plate, a third portion 80 which extends normal to the second portion from the end thereof to extend across both plates 42, and a fourth portion 82 which extends normal to the third portion 80 from the end thereof to extend along the other plate 42. The pin portion 74 is seen in FIG. 5 to extend outwardly beyond the fourth portion 82, and gravity will keep the first portion 76 oriented generally downwardly and thus the fourth portion 82 oriented generally in its position. When force is applied to the sling 30 such as by attachment of the platform 66, the pin portion 74 is pinched in the respective holes 70, and any tendency of the pin portion 74 to move out of the holes 70 will cause the fourth portion 82 to bear against its respective plate 42 to prevent the pin portion 74 from coming free of the holes 70.

It is of course apparent that the adjustment device 40, while illustrated for adjustability in 1 inch increments over a height of about 1 foot, can be made for adjustability over a greater (or lesser) height and in different increments. In the field, slings 10 of different lengths may be provided for gross height adjustment to within, for example, a foot by attachment of the device 40 to a sling 10 of a desired height (one sling 10 being for example a foot longer than another, etc.), then the device 40 used for finer height adjustment to, for example, within an inch of the desired height.

For insertion of the scaffold pin 72 for connecting the adjustment device 40 to a sling eyelet as well as its removal for disconnecting the adjustment device 40, a separate come-a-long or other tension relieving device is suitably attached to relieve the tension after which the come-a-long can be released. The come-a-long may, for example, be attached at one end to the bolt 48 (which may desirably be made longer for this purpose) or otherwise to the device 40 and at the other end to the upper eyelet 12 or upper structure 16. The suspension device 30 may also have a built-in tension-relieving device.

Referring to FIG. 6, there is illustrated generally at 140 an alternative embodiment of the adjustment device which is similar to adjustment device 40, having a pair of parallel plates 42 with pairs of spaced aligned holes 70 for incrementally adjustably receiving the pin portion 74 of scaffold pin 72 in one of the pair of holes, which pin portion 74 also receives a sling eyelet 12 for incrementally adjusting the length of the suspension device 30, and has differences as discussed hereinafter.

In the embodiment of FIGS. 4 and 5, the spacing between the plates 42 must be sufficient, for example, about 1 to 1½ inch, to desirably afford the ability to receive there between cable sleeves 14 of a wide range of sizes (diameters), as seen in FIG. 2. Since the hook portion 64 may have a lesser width, there is the need for the spacers 46 in the adjustment device 40 of FIGS. 4 and 5 to remove play. Again referring to FIG. 6, in order to eliminate the need for such spacers 46 without compromising the ability to receive large-size (large diameter) cable sleeves 14 between the plates 42, each of the plates 42 of adjustment device 140 is suitably formed to have offset end portions 142 between which the hook portion 64 is loosely (but without play) receivable and transition portions 144 connecting the offset portions 142 to the portions 146 containing the adjustment holes 70 respectively. Although a pin 44 or other suitable means could be used for connecting the plates 42 of the adjustment device 140, the plates 42 of adjustment device 140 are shown attached instead by welding a pair of spaced plates 148 and 150 between the plates 42, one 148 between the upper ends of the transition portions 144 and the other 150 between the lower ends of the transition portions 144 to thereby afford the desired rigidity of the adjustment device. A lightening hole, illustrated at 152 (FIG. 7) may be provided in each transition member 144 (such a hole in only one transition member shown).

For example and not for the purposes of limitation (here and elsewhere in this specification where examples are used), for a 2-ton eye hook 62, the portion 64 may have a width of about ½ inch, and the distance, illustrated at 154, between the offset plates 142 may be slightly more than the portion 64 width, i.e., about ½ inch, to allow free movement of the eye hook 62 without play. However, such a spacing between the plate portions 146 may undesirably not allow the use of the adjustment device with cable sleeves 14 having a width more than about ½ inch. In order to allow use with larger diameter cable sleeves 14, the distance, illustrated at 156, between the plate portions 146 is, for example, about 1½ inch, thus allowing the flexibility of choosing eye hooks 12 with sizes (widths) up to about 1½ inch. The cable portion 15 of the sling 10 may have a diameter of, for example, ½ inch.

Figure 7:
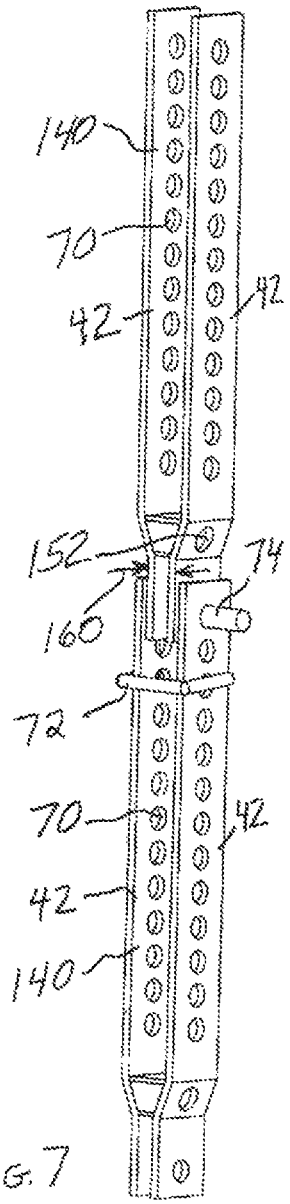
FIG. 7 is a perspective view of another alternative embodiment of the adjustment device.

Referring to FIG. 7, in order to provide even greater length adjustability, a pair (or more) of adjustment devices 140 are connected end to end (one end of one to the opposite end of the other) by scaffold pin 72 (or other suitable means) to form, with a hook 62 (not shown in FIG. 7) and a sling 10 (also not shown in FIG. 7) a suspension device in accordance with an alternative embodiment of the present invention. With the exception that their lengths may be different, the adjustment devices 140 in the embodiment of FIG. 7 may be identical or substantially identical. The offset portions 142 have a width, illustrated at 160, between their outer surfaces which allows them to be snugly received between the plate portions 146. Thus, for a distance 156 between the plate portions 146 of about 1½ inch, the distance 160 may be about 1½ inch, but such as to allow easy insertion and some play.

Referring to FIG. 6, it is considered desirable to minimize the spacing between the plates 42. If there were 4 plates 42 all connected along their lengths, the sling eyelet 12 may be so large that it cannot be "crammed" end-wise, as illustrated at 172, into the space between such 4 connected plates or would make the positioning of the eyelet 12 more cumbersome and difficult or would require that the spacing between the plates to be undesirably larger. To make the insertion and connection of the eyelet 12 easier, the lower end portions of each elongate plate (i.e., the end portion comprising portions 142 and 144 for each elongate plate 42) are attached to each other (as previously discussed), and the elongate plates 42 have projecting portions 146 which are shown to project cantileverly from the attached end portions and parallel to each other and which are shown to be spaced to allow the eye portion or eyelet 12 of the sling to be passed side-wise of the spaced projecting portions, as illustrated at 170, as well as end-wise 172, between the spaced projecting portions 146.

Figure 3:
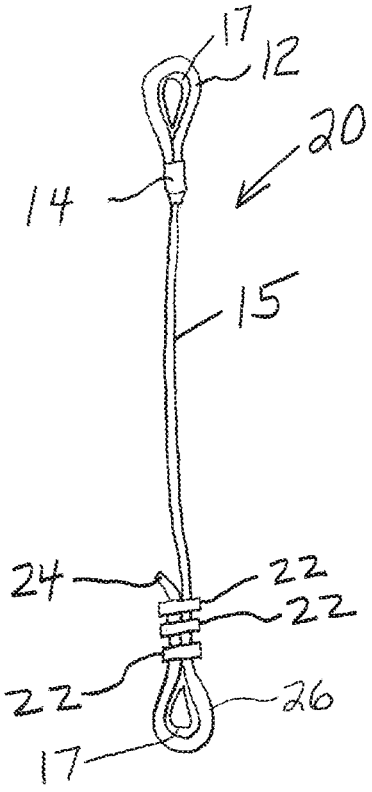
FIG. 3 PRIOR ART
FIG. 3 is a view similar to that of FIG. 1 of an adjustable sling assembly in accordance with the prior art.

The adjustable slings 20 illustrated in FIG. 3 have been used for many years for temporary platform erection or other scaffolding purposes, and it has accordingly been necessary for those many years to unfortunately live with the difficulties of installing the adjusting clamps 22 and the kinking of the cables resulting in the prior art slings 20 having to be disregarded after use. It has been a long time coming, but finally there is provided by the present invention adjustable slings, i.e., adjustable suspension assemblies utilizing adjustment devices 40 and 140 to eliminate such difficulties and satisfy the long-existing need for an adjustable sling which is easier to install and is re-usable.

It should be understood that, while the present invention has been described in detail herein, the invention can be embodied otherwise without departing from the principles thereof. For example, it is envisioned that the adjustment device 40 could comprise only one member and it is also envisioned that the adjustment device 40 could comprise only one plate or elongate member with spaced hubs (instead of the holes) for receiving an eyelet and with a retainer for retaining the eyelet on a hub. Such other embodiments are meant to come within the scope of the present invention as defined by the appended claims.

What is claimed is:

1. A method for adjustably suspending one structure relative to an other structure, the method comprising:

connecting an eye portion on one end of a sling, which comprises a cable, to a selected position along a length of an elongate member;

connecting an other end of the sling to the one structure;

connecting an end portion of the elongate member to the other structure;

selecting the elongate member to comprise a pair of elongate plates which have end portions respectively which are attached to each other, wherein the elongate plates have projecting portions which project cantileverly from the attached end portions and parallel to each other and which are spaced to allow the eye portion of the sling to be passed sideways between the spaced projecting portions;

wherein the step of connecting the eye portion of the sling to the selected position along the length of the elongate member comprises passing the eye portion between the pair of spaced projecting portions; and inserting a pin through a selected pair of a plurality of pairs of aligned holes spaced over lengths respectively of the projecting portions respectively and through the eye portion of the sling.

2. The method according to claim 1 wherein the step of connecting the end portion of the elongate member to the other structure comprises connecting a C-shaped hook, attached to the end portion of the elongate member, to the other structure.

3. The method according to claim 1 further comprising selecting the pin to be a scaffold pin which includes a locking part which utilizes gravity for retaining the pin in the holes.

4. The method according to claim 1 wherein the elongate member is a first of the elongate member and wherein the step of connecting the end portion of the elongate member to the other structure includes connecting one end portion of a second of the elongate member end-to-end to the end portion of the first elongate member and connecting an other end portion of the second elongate member to the other structure.

5. The method according to claim 4 wherein the step of connecting the other end portion of the second elongate member to the other structure comprises connecting a C-shaped hook, attached to the other end portion of the second elongate member, to the other structure.

6. A method for adjustably suspending one structure relative to an other structure, the method comprising:

providing an elongate member which has a pair of elongate plates which have end portions respectively wherein the end portions are attached and which have elongate projecting portions which project cantileverly from the attached end portions respectively and are parallel to each other, wherein the projecting portions are spaced to allow passing of an eye portion of a sling sideways between the projecting portions, and wherein each of the projecting portions has a plurality of holes which are spaced longitudinally of the elongate member such that at least some of the holes in one of the spaced projecting portions are aligned with at least some of the holes in the other of the spaced projecting portions;

passing an eye portion on one end of a sling, which comprises a cable, between the spaced projecting portions;

inserting a pin in the eye portion and in a pair of the aligned holes corresponding to a selected position along a length of the elongate member;

connecting an other end of the sling to the one structure; and connecting the attached end portions of the elongate plates to the other structure.

7. The method according to claim 6 wherein the step of connecting the attached end portions of the elongate plates to the other structure comprises connecting a C-shaped hook, attached to the attached end portions of the elongate plates, to the other structure.

8. The method according to claim 6 further comprising selecting the pin to be a scaffold pin which includes a locking part which utilizes gravity for retaining the pin in the holes.

9. The method according to claim 6 wherein the elongate member is a first elongate member, the step of connecting the end portion of the elongate member to the other structure includes connecting one end portion of a second elongate member end-to-end to the end portion of the first elongate member and connecting an other end portion of the second elongate member to the other structure.

10. The method according to claim 9 wherein the step of connecting an other end portion of the second elongate member to the other structure comprises connecting a C-shaped hook, attached to the other end portion of the second elongate member, to the other structure.

11. A method for adjustably suspending one structure relative to an other structure, the method comprising:

providing an elongate member which has a pair of spaced plates each comprising in a sequence longitudinally of each of the spaced plates an end portion, a transition portion integrally connected to the end portion at an end of the transition portion, and an elongate portion integrally connected to an other end of the transition portion, and the end portions are attached to each other, and wherein there is a first spacing between the elongate portions and a second spacing between the end portions, and the second spacing is less than the first spacing, and wherein each of the elongate portions of the spaced plates has a plurality of holes which are spaced longitudinally of the elongate member such that at least some of the holes in one of the elongate portions are aligned with at least some of the holes in the other of the elongate portions;

passing an eye portion on one end of a sling between the elongate portions of the spaced plates;

inserting a pin in the eye portion and in a pair of the aligned holes corresponding to a selected position along a length of the elongate member;

connecting an other end of the sling to the one structure; and connecting the end portions of the spaced plates of the elongate member to the other structure.

12. The method according to claim 11 wherein the step of connecting the end portions of the spaced plates to the other structure comprises connecting a hook, attached between the end portions, to the other structure.

13. The method according to claim 11 wherein the step of connecting the end portions of the spaced plates of the elongate member to the other structure comprises the substeps of:

providing an other of the elongate member;

inserting the end portions of the spaced plates of the elongate member between the elongate portions of the spaced plates respectively of the other elongate member in an end-to-end relationship;

inserting a pin in a pair of aligned apertures in the end portions respectively of the spaced plates of the elongate member and in one of the pairs of the aligned holes in the elongate portions of the spaced plates of the other elongate member thereby attaching the elongate member to the other elongate member; and connecting the end portions of the spaced plates respectively of the other elongate member to the other structure.

14. The method according to claim 13 wherein the step of connecting the end portions of the spaced plates respectively of the other elongate member to the other structure comprises connecting a hook, attached between the end portions of the spaced plates respectively of the other elongate member, to the other structure.

* * * * *